US011603633B2

(12) United States Patent
Utz

(10) Patent No.: US 11,603,633 B2
(45) **Date of Patent: *Mar. 14, 2023**

(54) TRAFFIC CONTROL CHANNELIZING SYSTEM AND METHOD OF USE

(71) Applicant: Terry Utz, Murrieta, CA (US)

(72) Inventor: Terry Utz, Murrieta, CA (US)

( * ) Notice: Subject to any disclaimer, the term of this patent is extended or adjusted under 35 U.S.C. 154(b) by 1071 days.

This patent is subject to a terminal disclaimer.

(21) Appl. No.: 16/155,760

(22) Filed: Oct. 9, 2018

(65) Prior Publication Data

US 2019/0040595 A1 Feb. 7, 2019

Related U.S. Application Data

(63) Continuation-in-part of application No. 15/041,238, filed on Feb. 11, 2016, now Pat. No. 10,094,080.

(60) Provisional application No. 62/114,988, filed on Feb. 11, 2015.

(51) Int. Cl.

| | |
|---|---|
| ***E01F 9/608*** | (2016.01) |
| ***E01F 9/688*** | (2016.01) |
| ***E01F 9/619*** | (2016.01) |
| ***E01F 9/654*** | (2016.01) |
| ***E01F 13/02*** | (2006.01) |

(52) U.S. Cl.

CPC ..... *E01F 9/608* (2016.02); *E01F 9/619* (2016.02); *E01F 9/654* (2016.02); *E01F 9/688* (2016.02); *E01F 13/02* (2013.01)

(58) Field of Classification Search

CPC . E01F 9/608; E01F 9/619; E01F 9/654; E01F 9/688; E01F 13/02

See application file for complete search history.

(56) References Cited

U.S. PATENT DOCUMENTS

| | | | | |
|---|---|---|---|---|
| 1,574,738 A * | 2/1926 | Cretney | ..... | E01F 9/553 404/15 |
| 2,379,741 A | 7/1945 | Palmquist | | |
| 2,483,734 A | 10/1949 | Neal | | |
| 2,719,505 A | 10/1955 | Blumenthal | | |

(Continued)

FOREIGN PATENT DOCUMENTS

| | | |
|---|---|---|
| AU | 2012101739 | 1/2013 |
| CN | 202466443 | 10/2012 |

(Continued)

OTHER PUBLICATIONS

Utz, Traffic Cone, PCT Application Serial No. PCT/US17/17654, Filed on Feb. 13, 2017, International Search Report and Written Opinion, dated May 8, 2017, 12 pages.

*Primary Examiner* — Nimeshkumar D Patel
*Assistant Examiner* — Tania Courson
(74) *Attorney, Agent, or Firm* — Schmeiser, Olsen & Watts, LLP

(57) ABSTRACT

A system of retroreflectorized traffic control channelizing devices is disclosed. The system comprises a plurality of channelizing devices, each device having a reflective member that is either white, yellow, or red in color. Those having a white reflective member are used to direct traffic from a right side of a traffic lane. Those having a yellow reflective member are used to direct traffic from a left side of a traffic lane. Those having a red reflective member are used to stop traffic for a road closure. A method of use of a system of retroreflectorized traffic control channelizing devices is also disclosed.

11 Claims, 17 Drawing Sheets

(56) References Cited

U.S. PATENT DOCUMENTS

| | | | | | |
|---|---|---|---|---|---|
| 2,981,149 | A | | 4/1961 | Stolarczyk | |
| 3,099,244 | A | | 7/1963 | Ralphs | |
| 3,212,415 | A | * | 10/1965 | Byrd | E01F 9/629 404/10 |
| 3,319,542 | A | | 5/1967 | Hansen | |
| 3,499,413 | A | | 3/1970 | Heard | |
| 3,596,627 | A | | 8/1971 | Monk | |
| 4,157,210 | A | | 6/1979 | Mesman | |
| 4,515,499 | A | * | 5/1985 | Furiate | E01F 13/02 116/63 R |
| 4,772,869 | A | | 9/1988 | Grammas et al. | |
| 5,030,029 | A | | 7/1991 | Johnsen | |
| 5,115,343 | A | | 5/1992 | Bennett | |
| 5,287,822 | A | | 2/1994 | Anderson | |
| 5,560,732 | A | | 10/1996 | Kulp | |
| 5,788,405 | A | | 8/1998 | Beard | |
| 5,857,801 | A | | 1/1999 | Brown | |
| 5,873,674 | A | * | 2/1999 | Hohl | E01F 9/573 404/9 |
| 5,917,432 | A | | 6/1999 | Rathbone | |
| 6,014,941 | A | * | 1/2000 | Bent | E01F 9/688 116/63 P |
| 6,182,600 | B1 | | 2/2001 | Brown et al. | |
| 6,305,312 | B1 | | 10/2001 | Bent | |
| 6,338,311 | B1 | | 1/2002 | Ho | |
| 6,520,712 | B2 | | 2/2003 | Kulp | |
| 6,536,369 | B1 | | 3/2003 | Bent | |
| 7,007,630 | B2 | | 3/2006 | Garcia | |
| 7,077,600 | B1 | | 7/2006 | Whinery | |
| 7,228,813 | B2 | | 6/2007 | Flamingo | |
| 7,690,860 | B1 | * | 4/2010 | Utz | E01F 9/677 404/9 |
| 8,302,551 | B2 | * | 11/2012 | Julnes | E01F 9/654 116/63 P |
| 8,602,584 | B2 | * | 12/2013 | Ghafoori | H05B 47/155 362/186 |
| 9,096,978 | B2 | * | 8/2015 | Carlson | E01F 13/044 |
| 9,512,578 | B1 | | 12/2016 | Dvoracek | |
| 9,863,578 | B2 | | 1/2018 | Cuttill | |
| 10,094,080 | B2 | * | 10/2018 | Utz | E01F 9/654 |
| 10,221,530 | B2 | | 3/2019 | Driskell | |
| 10,745,871 | B2 | * | 8/2020 | Utz | E01F 9/654 |
| 11,035,087 | B1 | * | 6/2021 | Mattia | E01F 9/619 |
| 2002/0073912 | A1 | | 6/2002 | Kuo | |
| 2005/0076822 | A1 | | 4/2005 | Levine | |
| 2007/0012237 | A1 | | 1/2007 | Nielsen | |
| 2007/0113774 | A1 | | 5/2007 | Kuo | |
| 2012/0256765 | A1 | * | 10/2012 | Selevan | G08G 1/07 340/907 |
| 2014/0069320 | A1 | | 3/2014 | Wang | |
| 2014/0104833 | A1 | | 4/2014 | Alsaffar | |
| 2014/0283733 | A1 | | 9/2014 | Archer | |
| 2018/0058022 | A1 | | 3/2018 | Adeleke | |

FOREIGN PATENT DOCUMENTS

| | | |
|---|---|---|
| CN | 202809516 | 3/2013 |
| CN | 20298980 | 6/2013 |
| FR | 2871482 | 12/2005 |
| GB | 2274295 | 7/1994 |
| JP | 2008174963 | 7/2008 |
| MU | 8302075-6 | 6/2005 |
| WO | 2015155457 | 10/2015 |

* cited by examiner

TRAFFIC CONTROL CHANNELIZING SYSTEM AND METHOD OF USE

CROSS REFERENCE TO RELATED APPLICATION[S]

This application is a continuation-in-part of the earlier U.S. Utility patent application entitled "TRAFFIC CONE," Ser. No. 15/041,238, filed Feb. 11, 2016, which claims priority to U.S. Provisional Patent Application entitled "TRAFFIC CONE," Ser. No. 62/114,988, filed Feb. 11, 2015, the disclosures of which are hereby incorporated entirely herein by reference.

BACKGROUND OF THE INVENTION

Technical Field

This invention relates generally to traffic control devices and more particularly to a system of retroreflectorized traffic control channelizing devices.

State of the Art

According to the 2009 Edition of the Manual on Uniform Traffic Control Devices (MUTCD), "When the normal function of the roadway, or a private road open to public travel, is suspended, [temporary traffic control (TTC)] planning provides for continuity of the movement of motor vehicle, bicycle, and pedestrian traffic (including accessible passage); transit operations; and access (and accessibility) to property and utilities. The primary function of TTC is to provide for the reasonably safe and effective movement of road users through or around TTC zones while reasonably protecting road users, workers, responders to traffic incidents, and equipment. Of equal importance to the public traveling through the TTC zone is the safety of workers performing the many varied tasks within the work space. TTC zones present constantly changing conditions that are unexpected by the road user. This creates an even higher degree of vulnerability for the workers and incident management responders on or near the roadway . . . . At the same time, the TTC zone provides for the efficient completion of whatever activity interrupted the normal use of the roadway."

The MUTCD further states, "The function of channelizing devices is to warn road users of conditions created by work activities in or near the roadway and to guide road users. Channelizing devices include cones, tubular markers, channelizers . . . , portable delineators, vertical panels, drums, barricades, and longitudinal channelizing devices. Channelizing devices provide for smooth and gradual vehicular traffic flow from one lane to another, onto a bypass or detour, or into a narrower traveled way. They are also used to channelize vehicular traffic away from the work space, pavement drop-offs, pedestrian or shared-use paths, or opposing directions of vehicular traffic."

Traffic control channeling devices are required to be retroreflectorized or equipped with lighting devices for maximum visibility. Conventional traffic control channeling devices have reflective members that are limited to white (or white with a secondary orange background) in color. Since the primary reflective members of conventional traffic control channeling devices are all white in color, there is no color distinction between those devices used for directing traffic from a right side of a traffic lane, directing traffic from a left side of a traffic lane, or stopping traffic for a road closure. For this reason, the purpose of the placement of conventional traffic control channeling devices with reflective members limited to white in color is often unclear to road users.

Markings on highways and on private roads open to public travel have important functions in providing guidance and information for the road user. The colors for markings conform to standard highway colors. For example, white markings are used to delineate the right-hand edge of the roadway, yellow markings are used to delineate the left-hand edge of the roadway, and red markings are used to delineate one-way roadways, ramps, or travel lanes that should not be entered or used in the direction from which the markings are visible. As stated above, conventional traffic control devices do not utilize these distinguishing colors.

Accordingly, there is a need for an improved system of retroreflectorized traffic control channelizing devices that utilizes channelizing devices with reflective members of colors that correspond to standard colors of highway markings.

DISCLOSURE OF THE INVENTION

The present invention relates to traffic control devices and more particularly to a system of retroreflectorized traffic control channelizing devices.

An embodiment of a system of retroreflectorized traffic control channelizing devices comprises a plurality of channelizing devices that may include cones, tubular markers, channelizers, portable delineators, vertical panels, drums, Type-I barricades, Type-II barricades, Type-III barricades, longitudinal channelizing devices, or the like, or a combination of two or more thereof. Each channelizing device has at least one reflective member that is either white, yellow, or red in color. Those devices with white reflective members operate to direct a right side of a traffic lane. Those devices with yellow reflective members operate to direct a left side of a traffic lane. Those devices with red reflective members operate to stop traffic for a road closure. In some embodiments, such as in those embodiments that include cones, the at least one reflective member may be an interchangeable sleeve, such as may be installed by sliding the sleeve over the device.

A method of use of a system of retroreflectorized traffic control channelizing devices is also disclosed.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

Embodiments of the present invention relate to traffic control devices and more particularly to a system of retroreflectorized traffic control channelizing devices.

Figure 12:
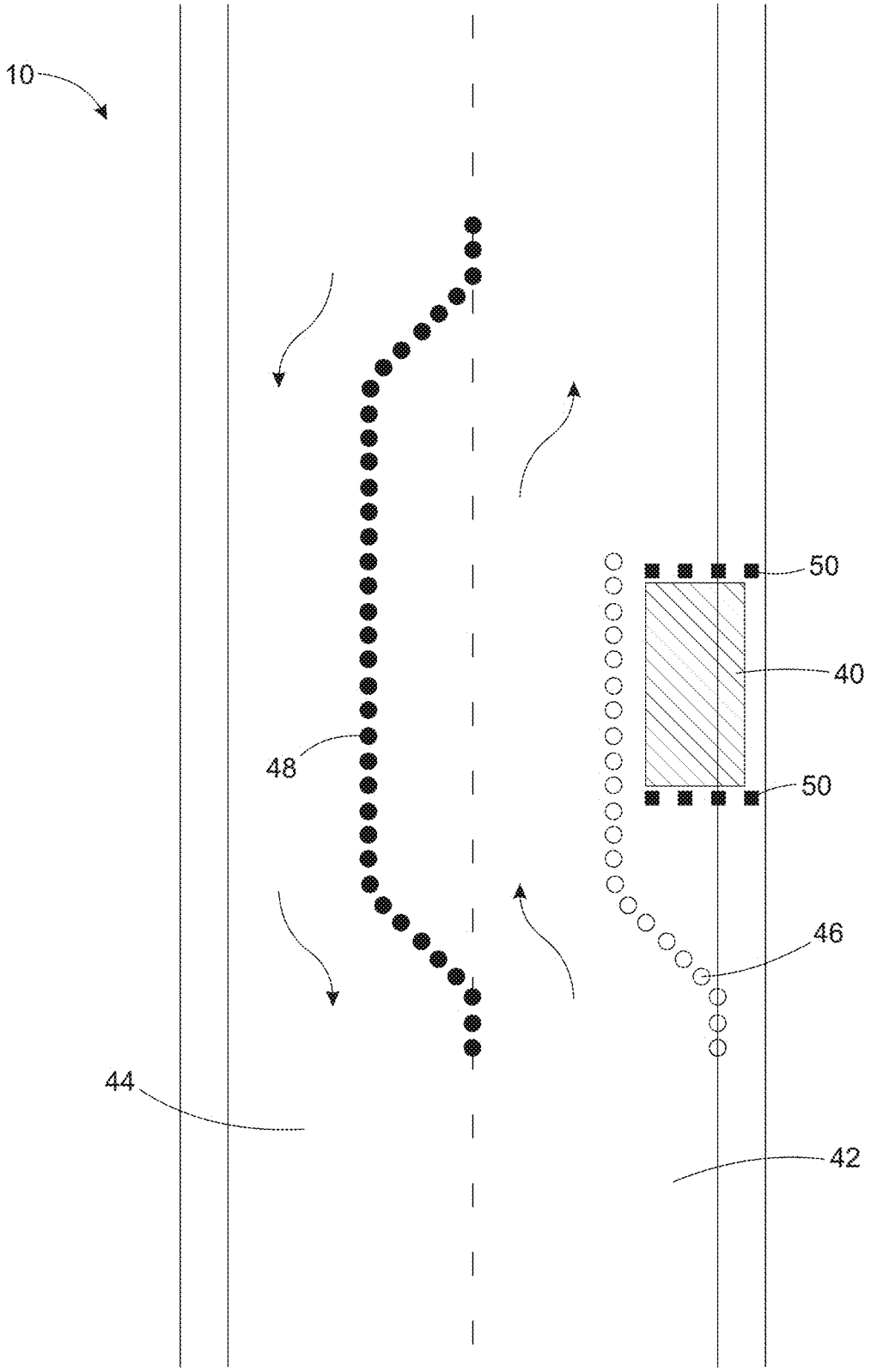
FIG. 12 illustrates a system of retroreflectorized traffic control channelizing devices on a roadway, according to an embodiment.

Referring to the drawings, as shown in FIG. 12, an embodiment of the system 10 comprises a plurality of retroreflectorized traffic control channelizing devices 46, 48 and 50, that may include cones, tubular markers, channelizers, portable delineators, vertical panels, drums, Type-I barricades, Type-II barricades, Type-III barricades, longitudinal channelizing devices, alternative channelizers, or the like, or a combination of two or more thereof.

Figure 1:
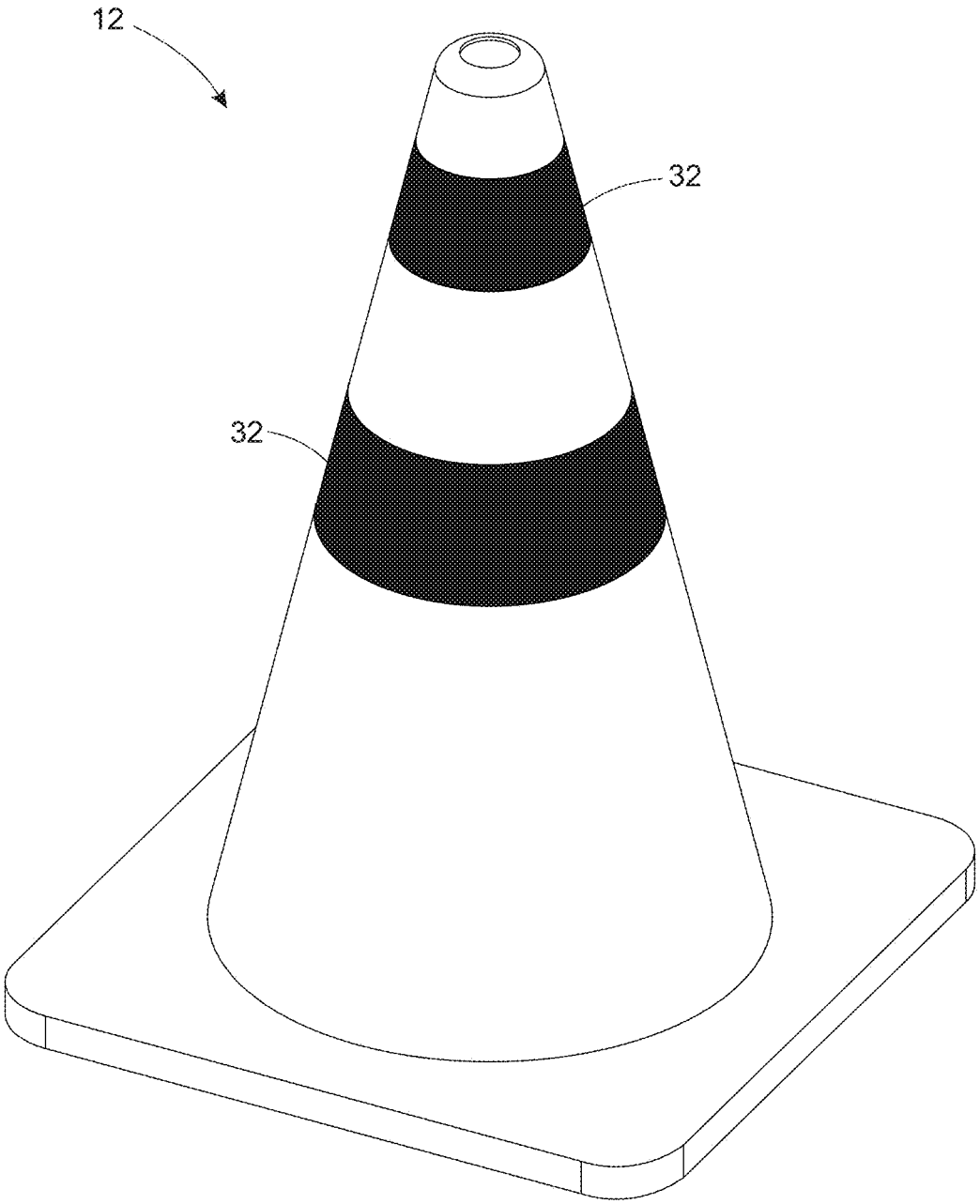
FIG. 1 is a perspective view of a cone, according to an embodiment.
Figure 2:
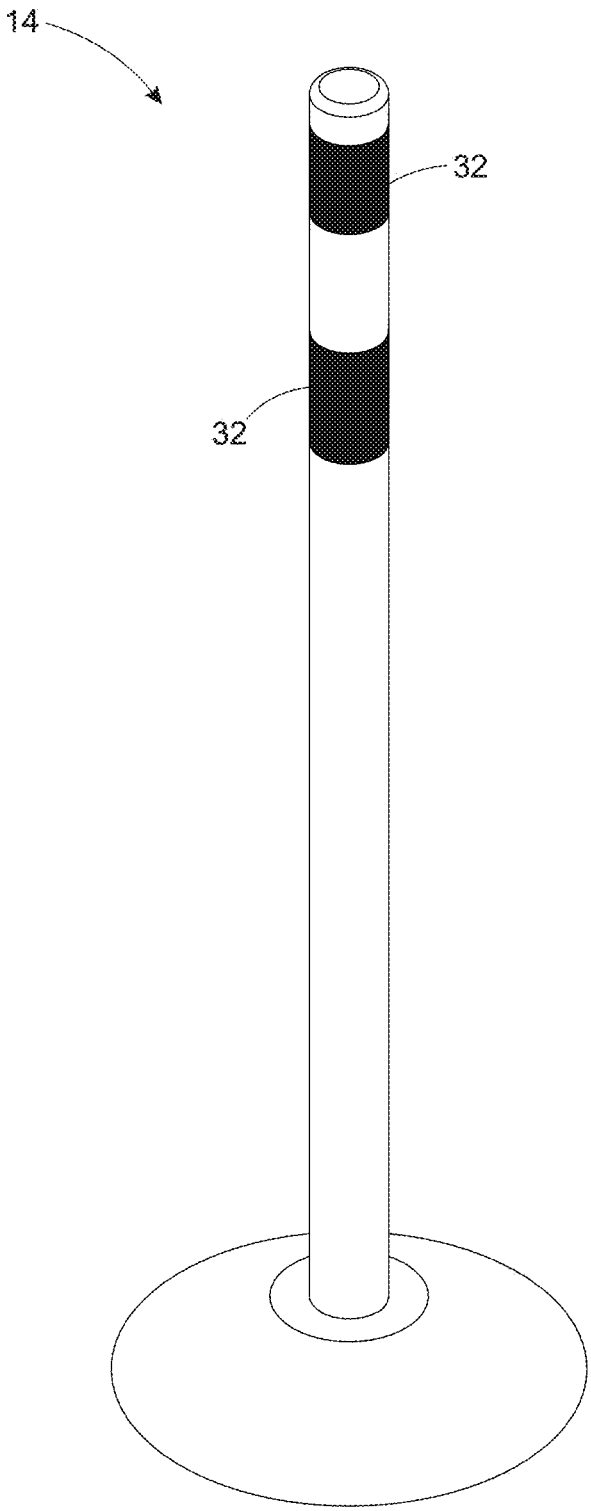
FIG. 2 is a perspective view of a tubular marker, according to an embodiment.
Figure 3:
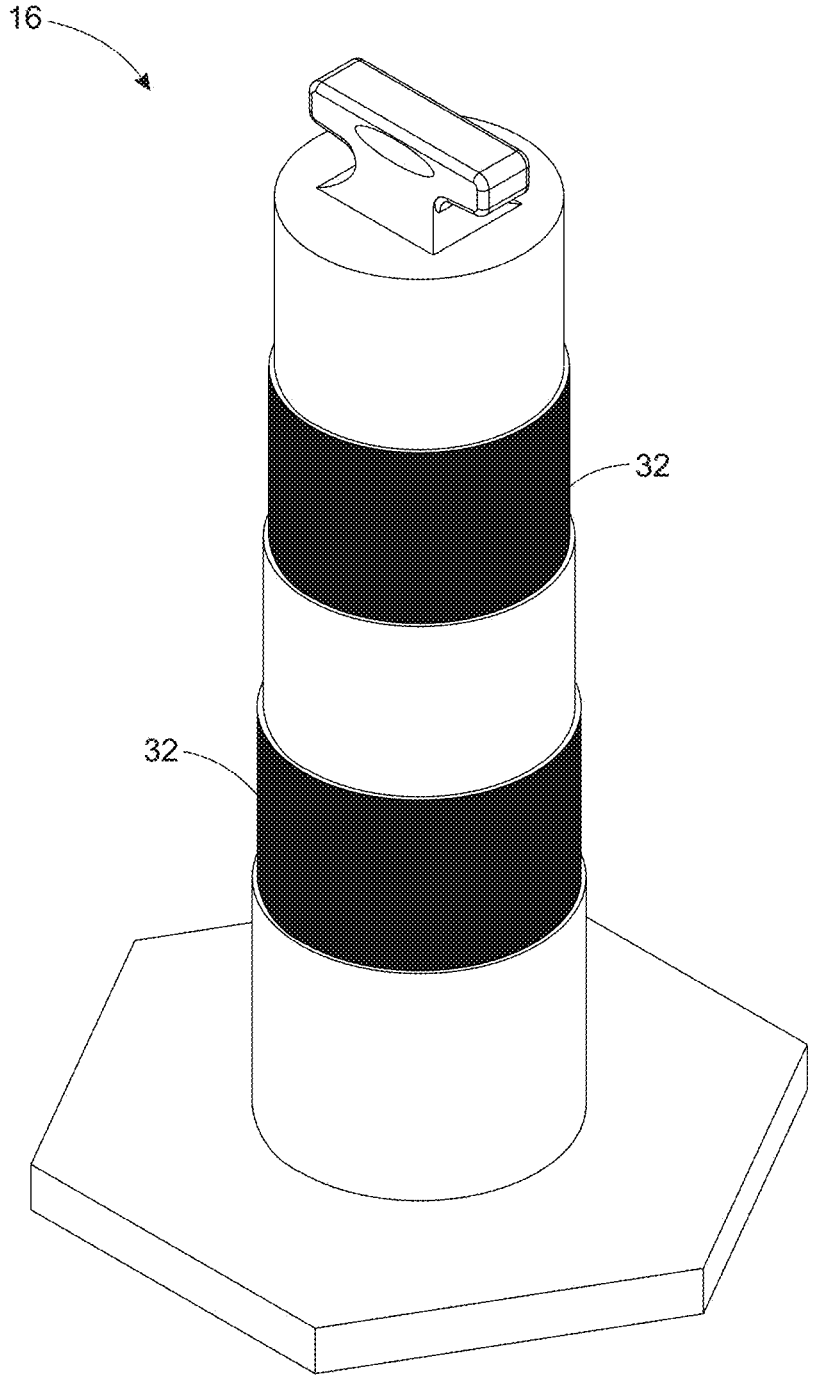
FIG. 3 is a perspective view of a channelizer, according to an embodiment.
Figure 4:
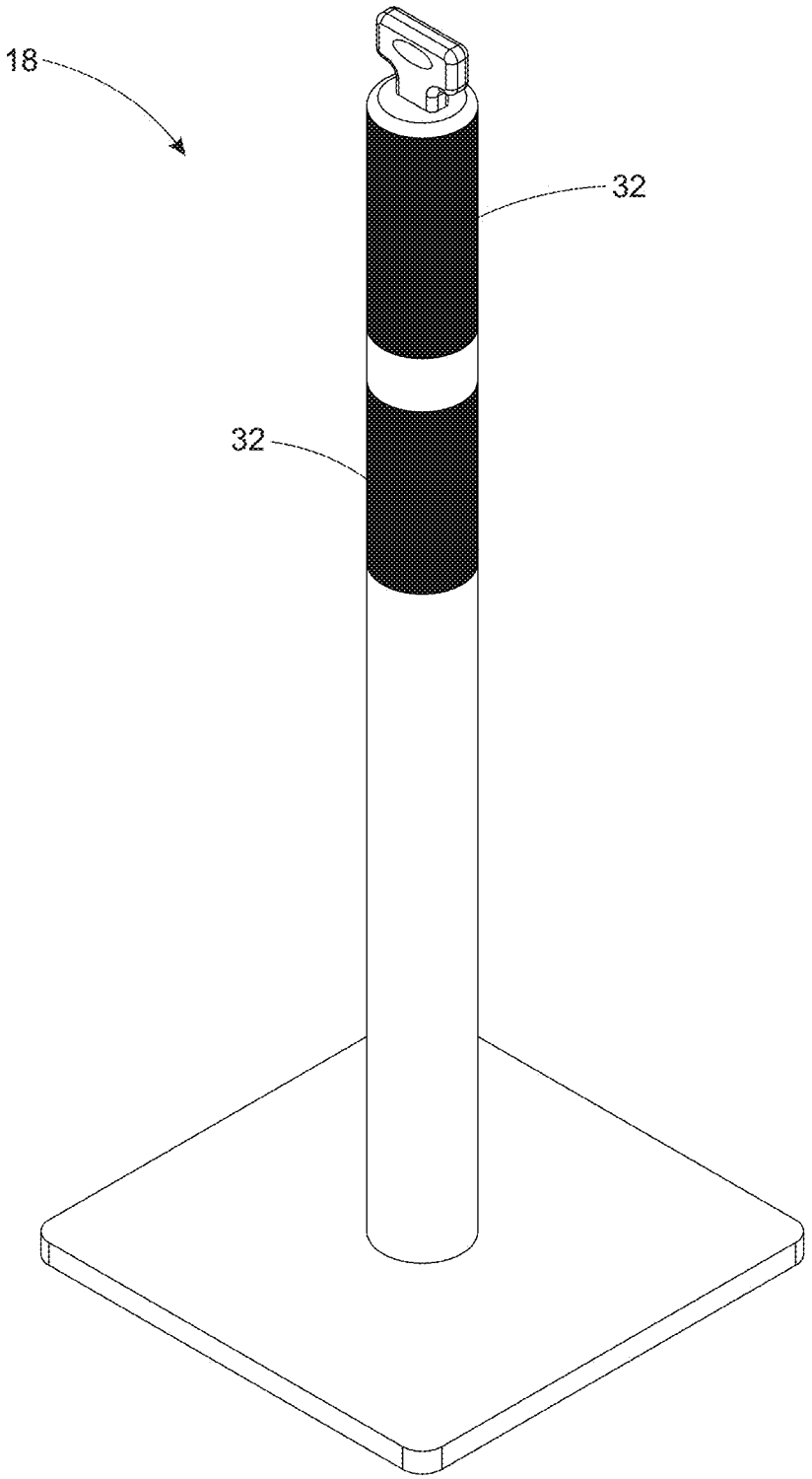
FIG. 4 is a perspective view of a portable delineator, according to an embodiment.
Figure 5:
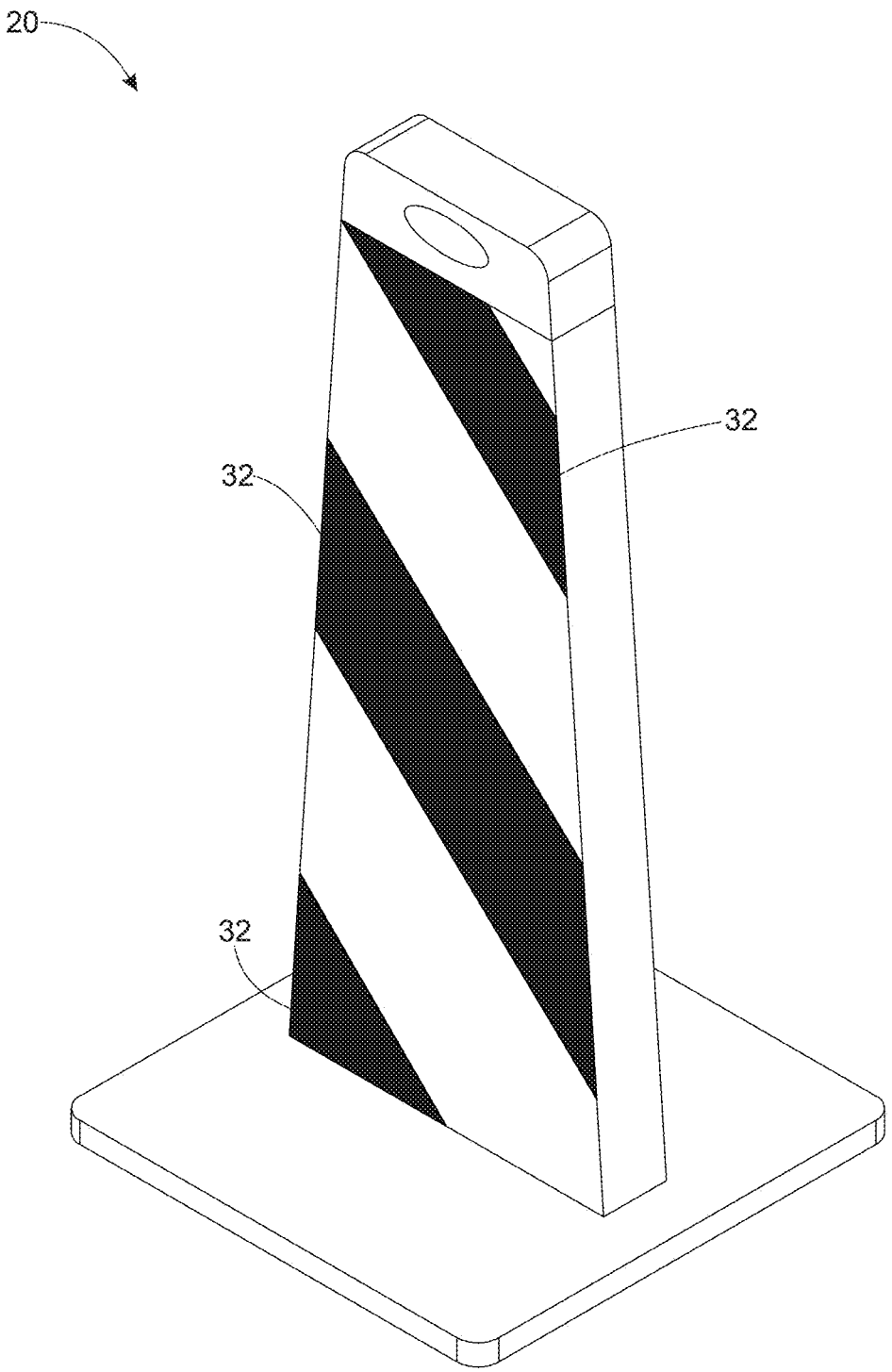
FIG. 5 is a perspective view of a vertical panel, according to an embodiment.
Figure 6:
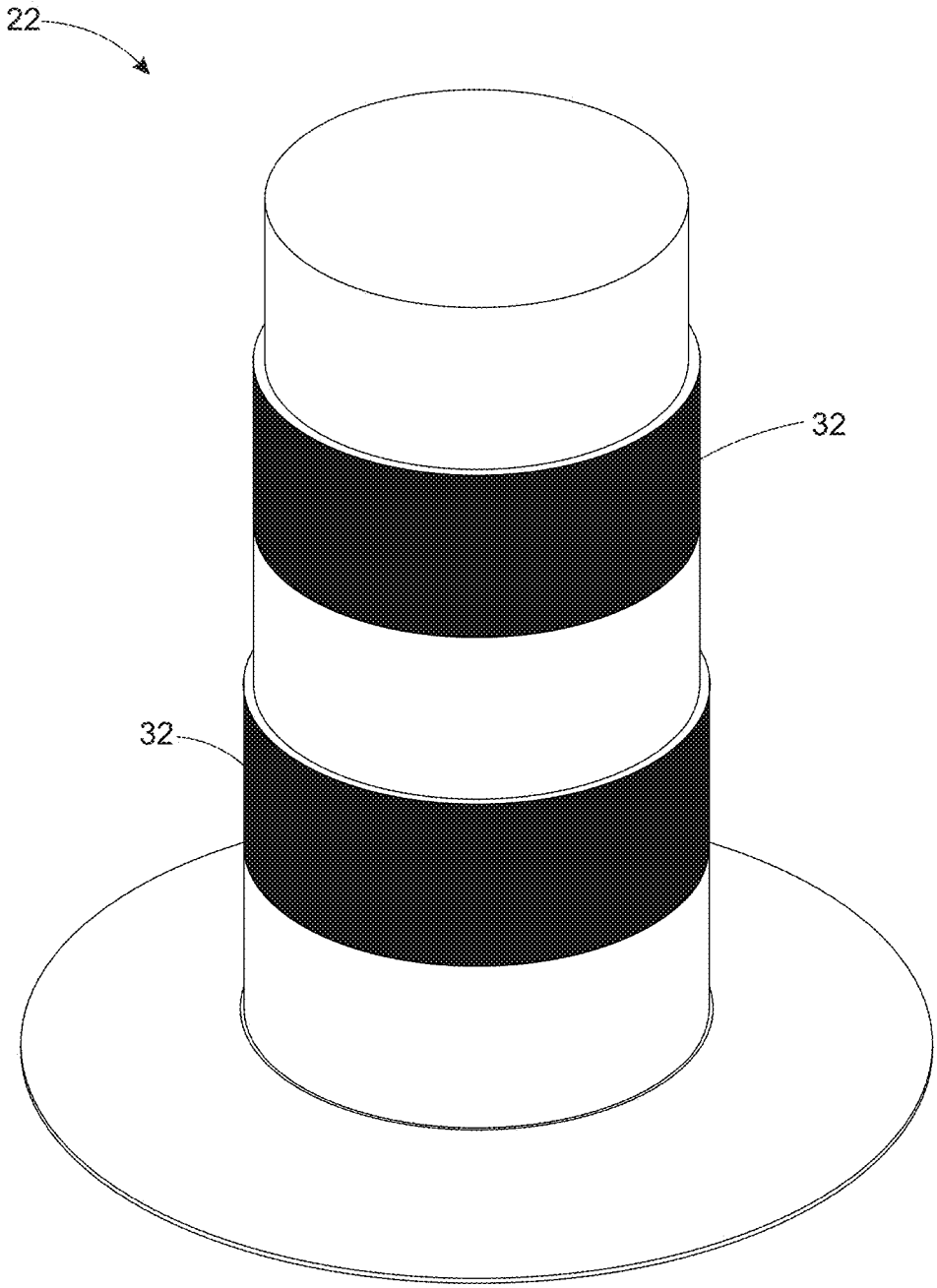
FIG. 6 is a perspective view of a drum, according to an embodiment.
Figure 7:
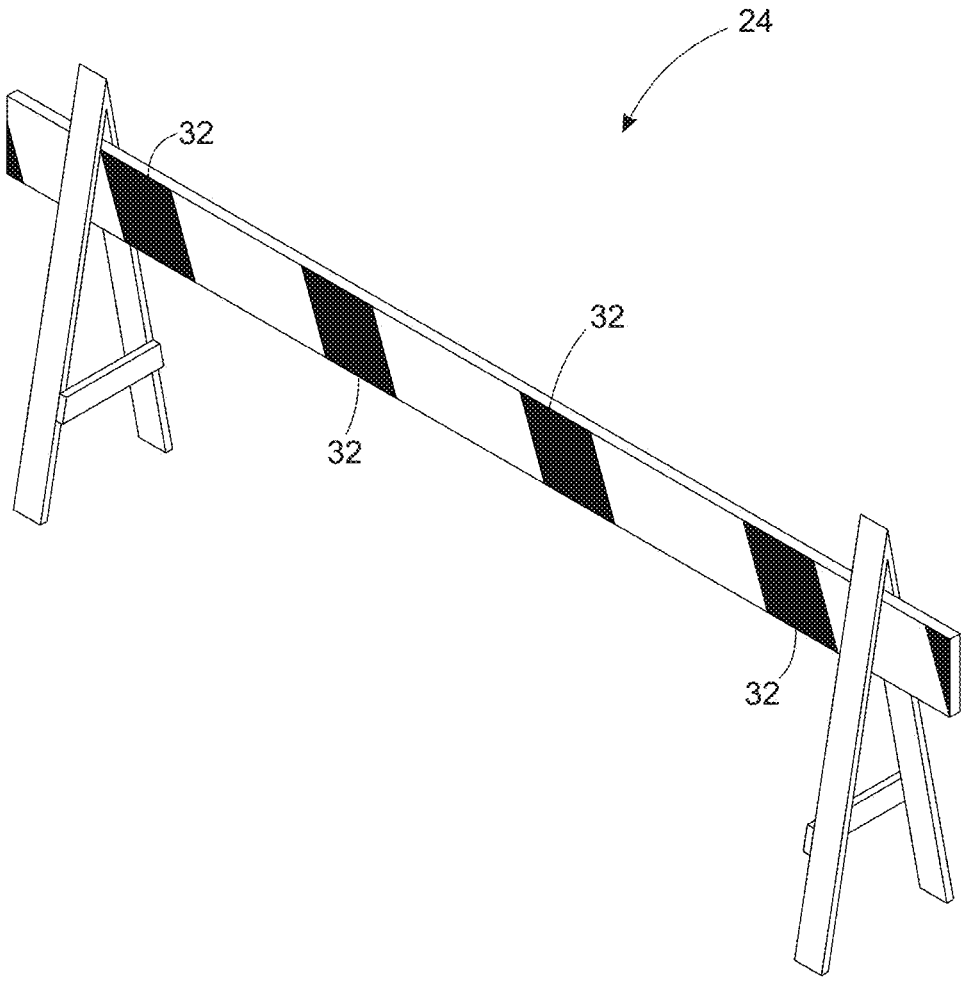
FIG. 7 is a perspective view of a Type-I barricade, according to an embodiment.
Figure 8:
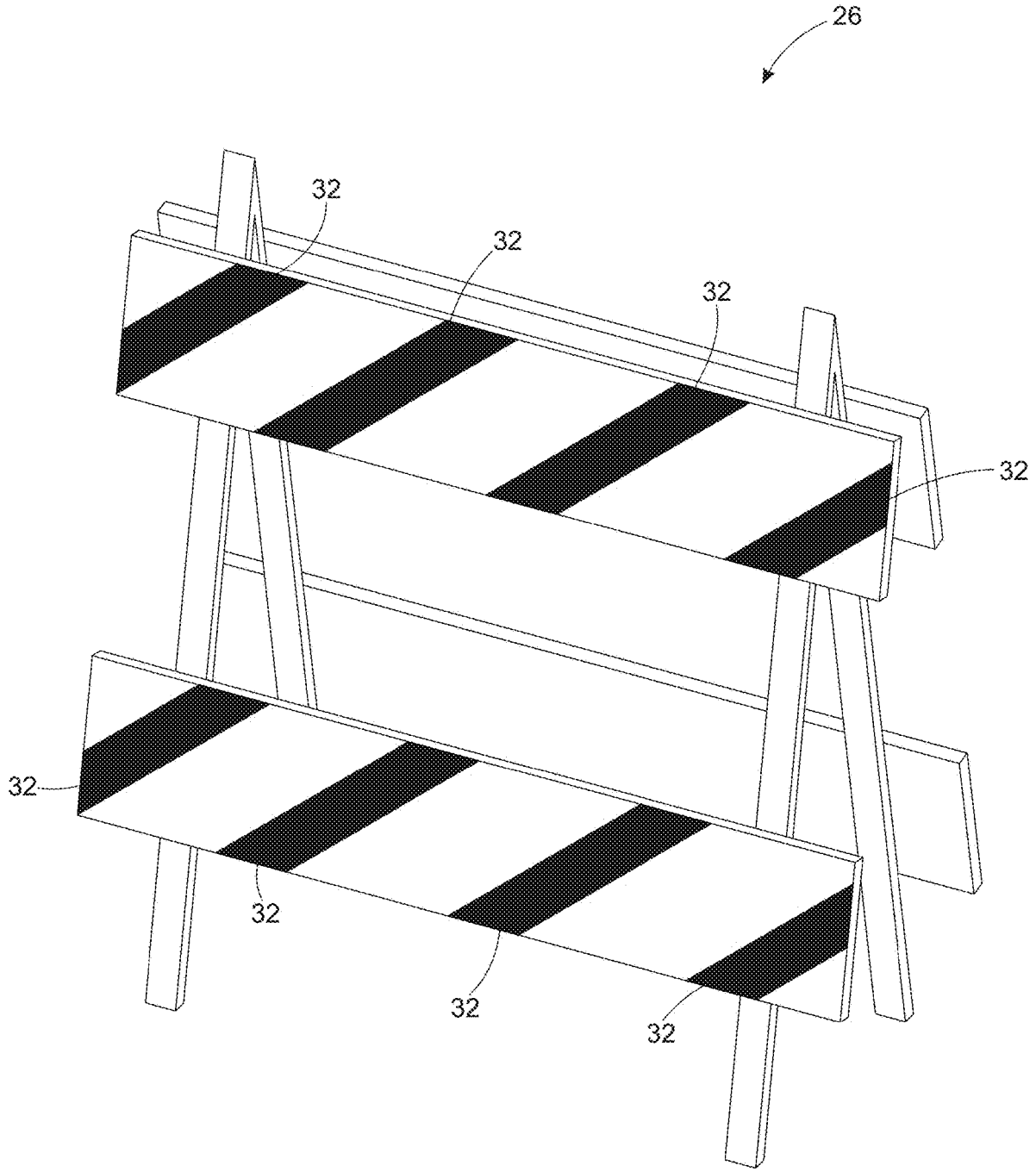
FIG. 8 is a perspective view of a Type-II barricade, according to an embodiment.
Figure 9:
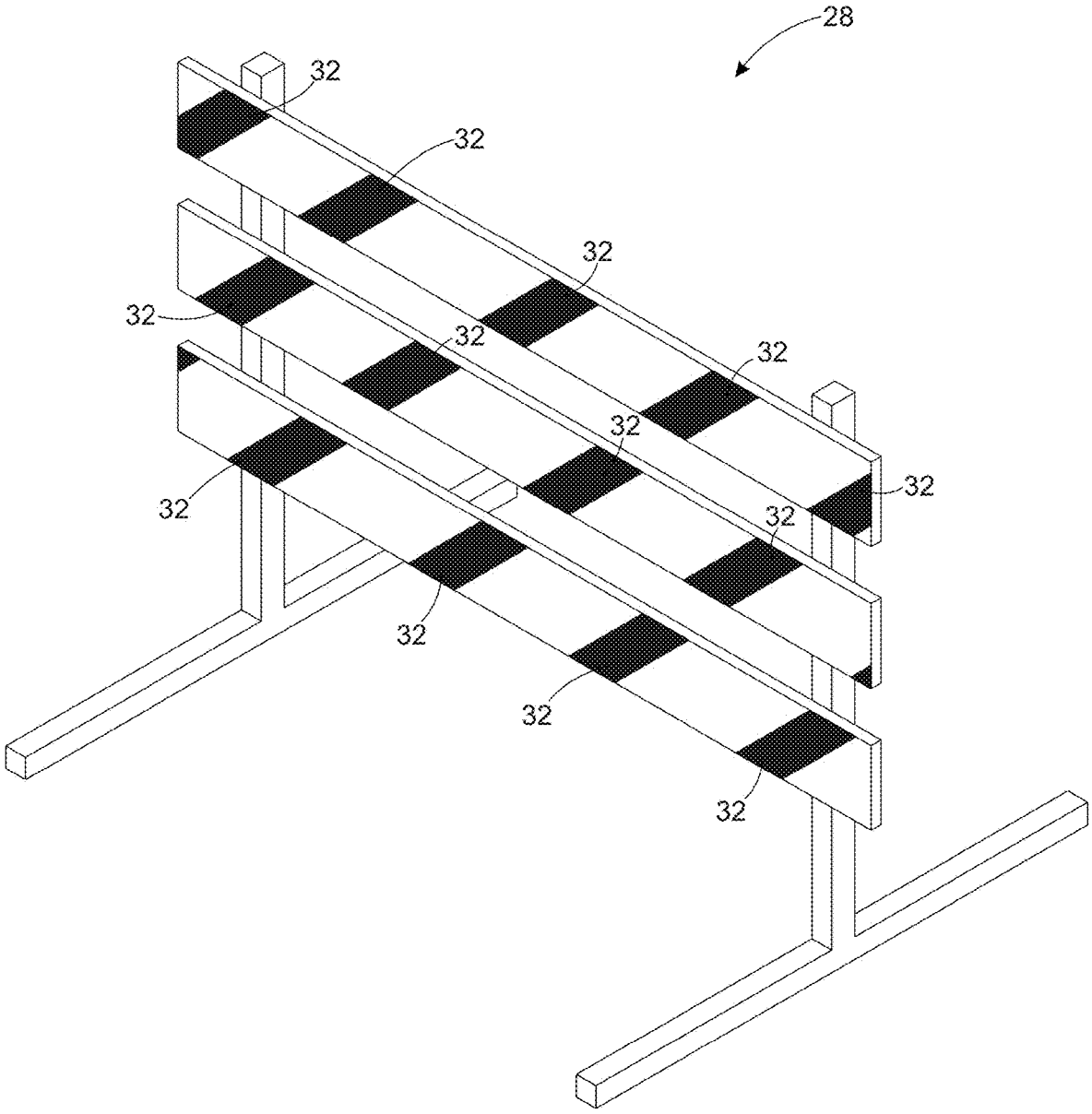
FIG. 9 is a perspective view of a Type-III barricade, according to an embodiment.
Figure 10:
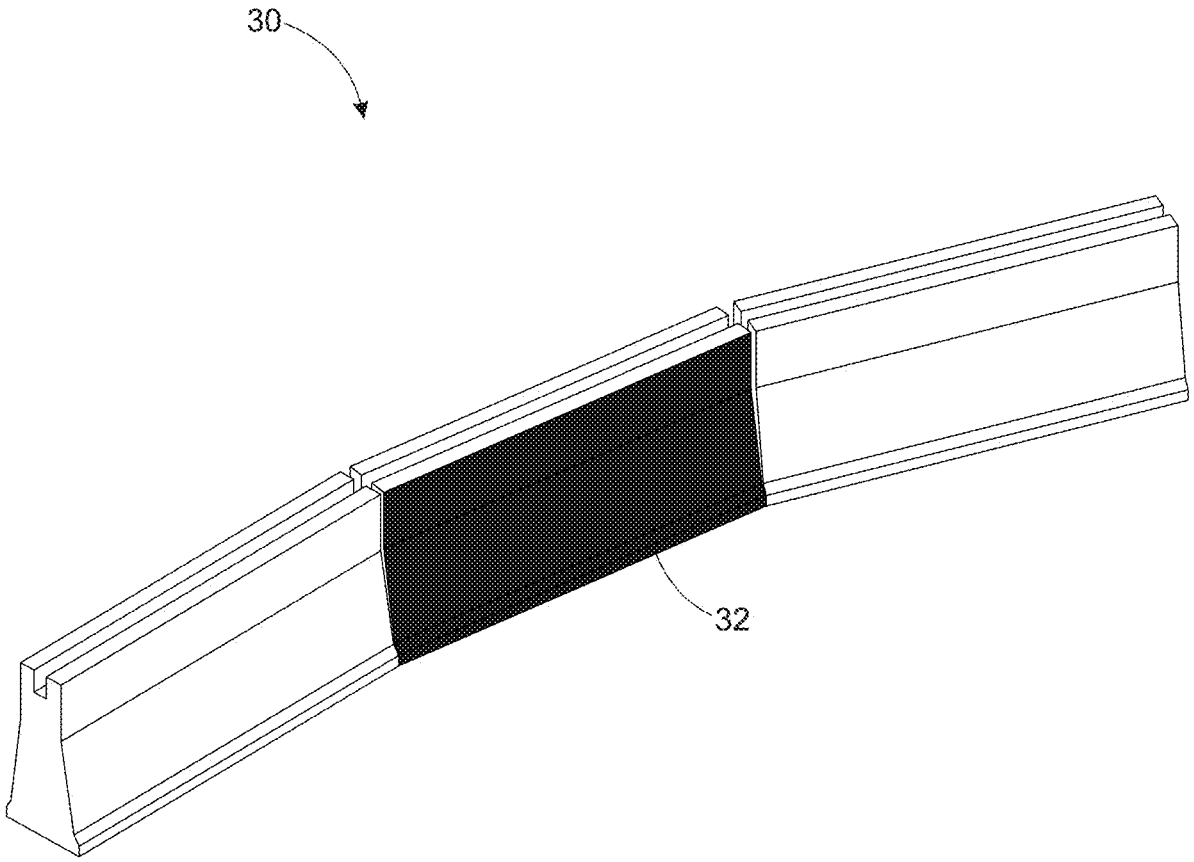
FIG. 10 is a perspective view of a longitudinal channeling device, according to an embodiment.
Figure 14:
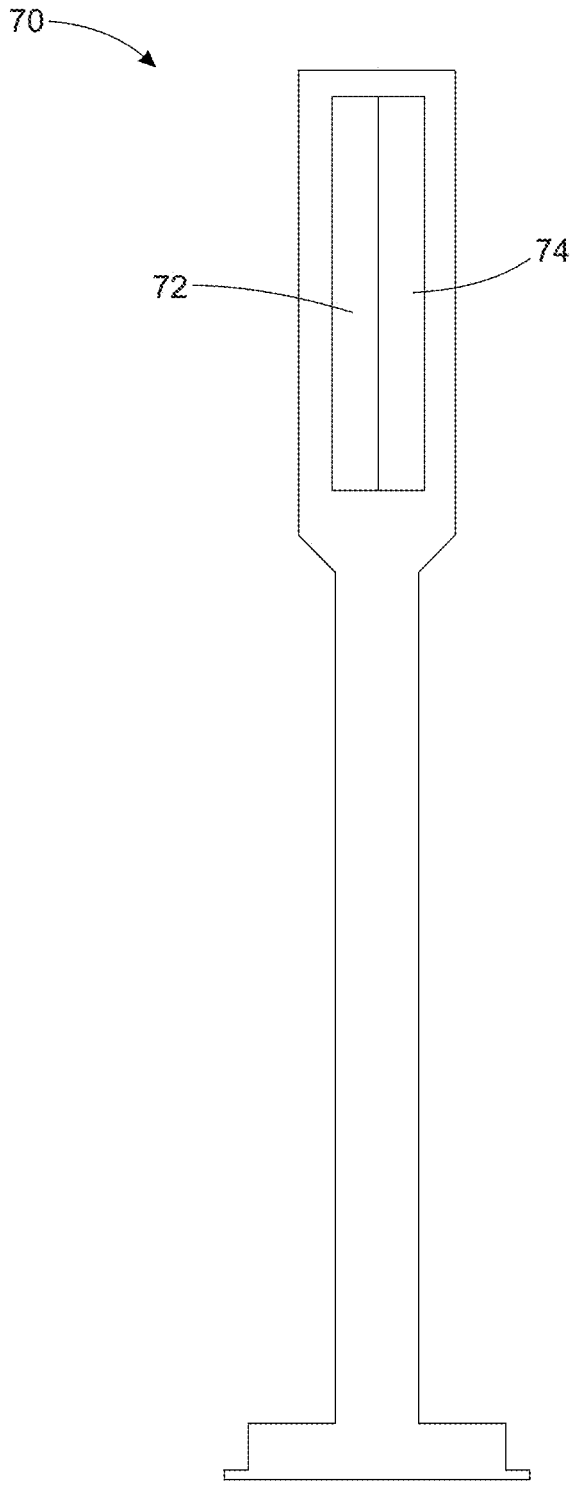
FIG. 14 is a front view of an alternative channelizer, according to an embodiment.

According to embodiments, FIG. 1 shows a cone 12, FIG. 2 shows a tubular marker 14, FIG. 3 shows a channelizer 16, FIG. 4 shows a portable delineator 18, FIG. 5 shows a vertical panel 20, FIG. 6 shows a drum 22, FIG. 7 shows a Type-I barricade 24, FIG. 8 shows a Type-II barricade 26, FIG. 9 shows a Type-III barricade 28, FIG. 10 shows a longitudinal channeling device 30, and FIG. 14 shows an alternative channelizer 70. The shapes and configurations of the traffic control channelizing devices 46, 48 and 50, shown in the drawings are not intended to be limiting. The drawings in FIGS. 1-10 are intended to illustrate the various types of traffic control channelizing devices, according to embodiments of the present invention, similar to those in common use, except that each channelizing device of the present invention has at least one reflective member 32 that is either white, yellow, or red in color. Those devices with white reflective members operate to direct a right side of a traffic lane. Those devices with yellow reflective members operate to direct a left side of a traffic lane. Those devices with red reflective members operate to stop traffic for a road closure.

In some embodiments, as shown in FIG. 14, the system may comprise at least one alternative channelizer 70 having at least one reflective member 72 of one color on the left, and at least one reflective member 74 of a second color on the right. For example, the at least one alternative channelizer 70 may have at least one reflective member 72 on the left side that is white in color and at least one reflective member 74 on the right side that is yellow in color. In these embodiments, the at least one alternative channelizer 70 may be used, for example, between a high occupancy vehicle (HOV) lane or toll lane on the left and a regular traffic lane on the right, wherein the white color on the left corresponds to the white stripe on the left side of a composite white and yellow highway marking and the yellow color on the right corresponds to the yellow stripe on the right side of a composite white and yellow highway marking.

FIG. 12 illustrates a system 10 of retroreflectorized traffic control channelizing devices according to an embodiment of the present invention. The system of FIG. 12 may comprise channelizing devices 46 with white reflective members, represented by open circles, channelizing devices 48 with yellow reflective members, represented by solid-colored circles, and channelizing devices 50 with red reflective members, represented by solid-colored squares. Referring to FIG. 12, traffic in first-direction lane 42 is diverted around temporary traffic control (TTC) area 40 by channelizing devices 46, 48 and 50, wherein channelizing devices 46 having white reflective members operate to direct a right side of first-direction lane 42, channelizing devices 48 having yellow reflective members operate to direct the left side of traffic lane 42, and channelizing devices 50 having red reflective members operate to stop traffic from traveling through the TTC area. Similarly, traffic in second-direction lane 44 is diverted around TTC area 40 by channelizing devices 48 with yellow reflective members operating to direct the left side of traffic lane 44. The direction of traffic flow in first-direction lane 42 and second-direction lane 44 is indicated by the arrows on FIG. 12.

Figure 13A:
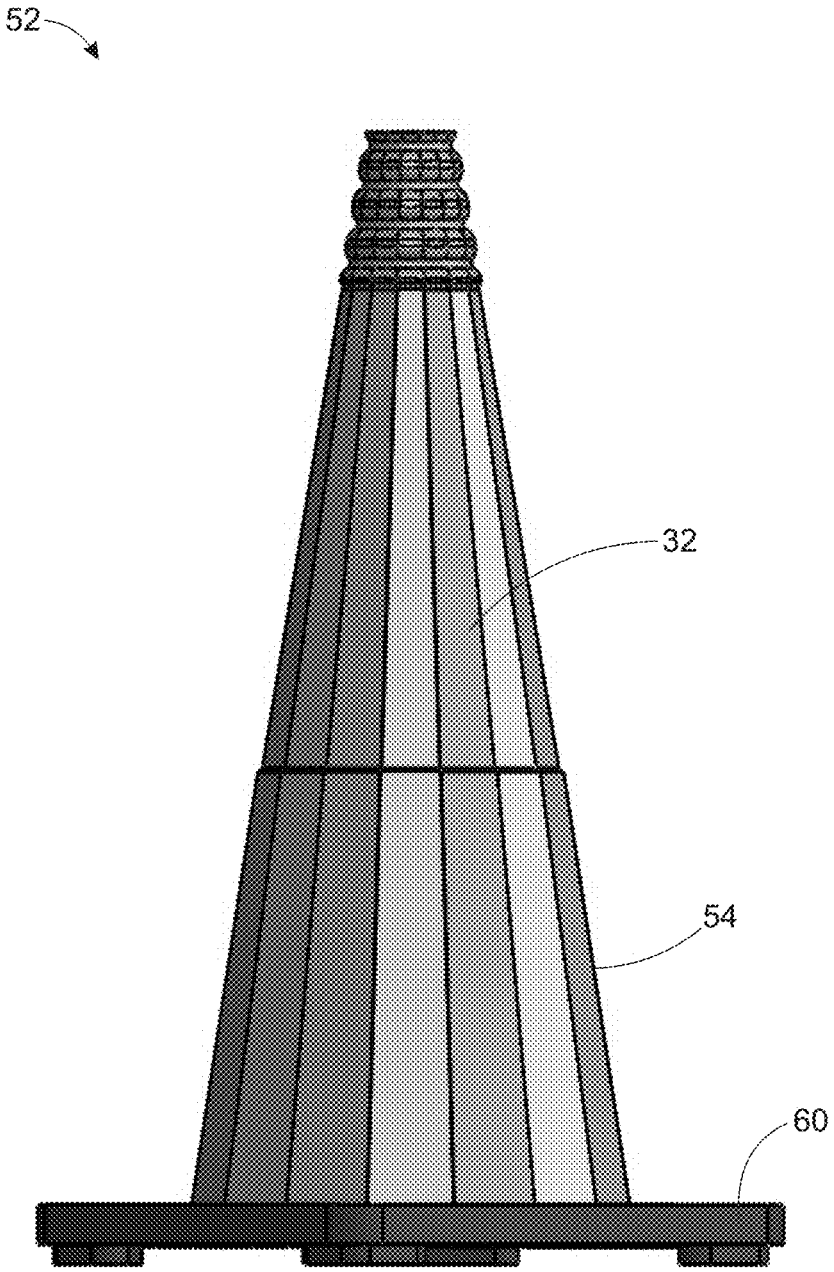
FIG. 13A is a front view of a two-piece cone, according to an embodiment.
Figure 13B:
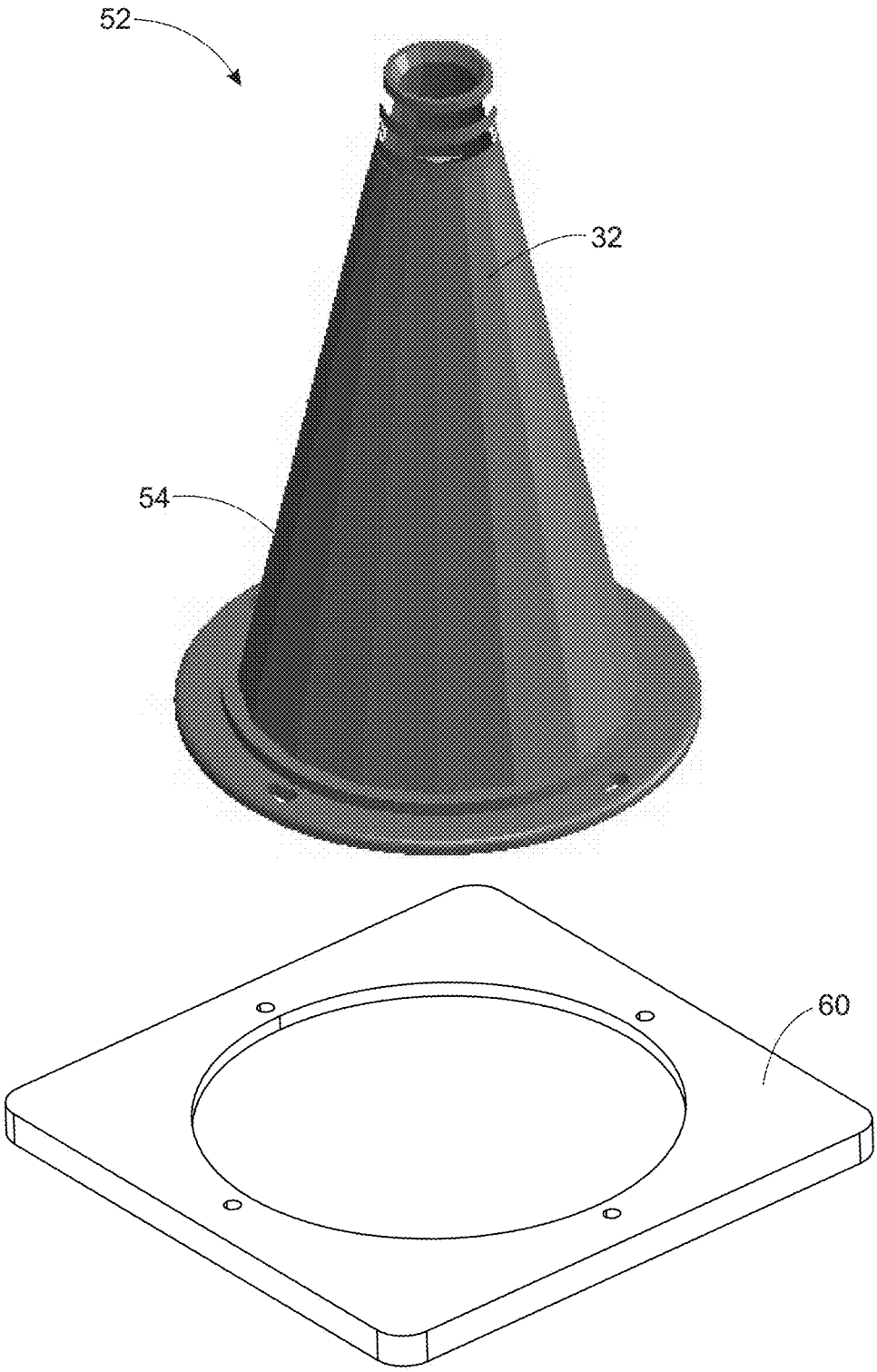
FIG. 13B is a perspective view of a two-piece cone with a detached base, according to an embodiment.

In some embodiments, the at least one channelizing device may be a two-piece cone 52, as shown in FIGS. 13A and 13B, wherein the two-piece cone 52 has a cone body 54 that is removably coupled to a base 60. Such coupling may be by any of a variety of removably coupling means, such as keyhole slot and knob, or the like.

Figure 15A:
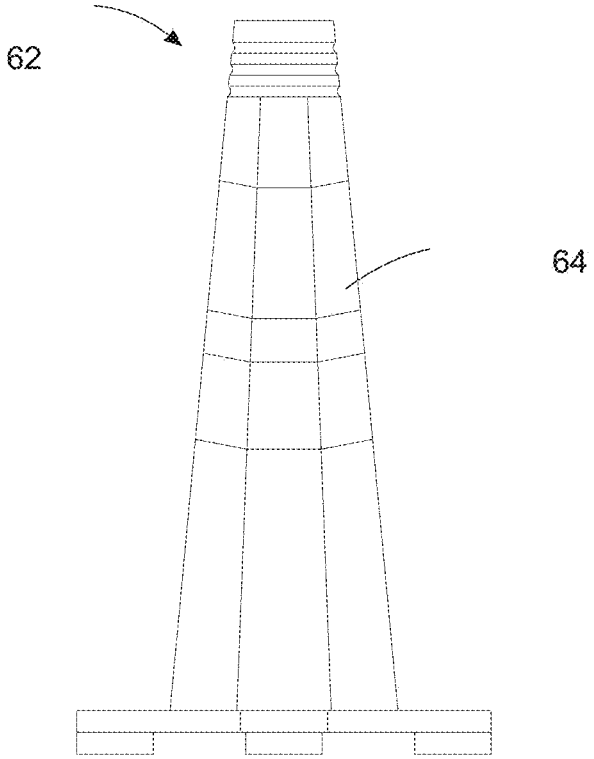
FIG. 15A is a front view of a cone with at least five sides and a triangular base, according to an embodiment.
Figure 15B:
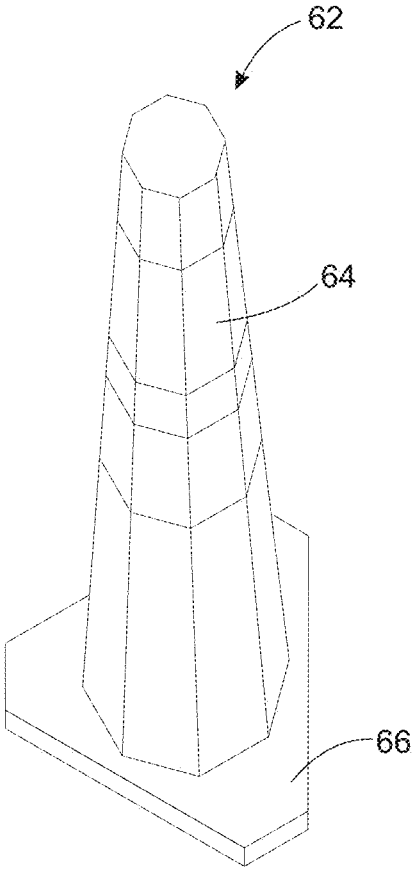
FIG. 15B is a perspective view of a cone with at least five sides and a triangular base, according to an embodiment.

In some embodiments, at least one channelizing device may be a cone 62 having at least five flat sides, as shown in FIGS. 15A and 15B. In some embodiments, at least one channelizing device may have a triangular base 66, as shown in FIGS. 15A and 15B.

It is understood that the configuration of channelizing devices 46, 48 and 50, as shown in FIG. 12 is not intended to be limiting. The configuration shown in FIG. 12 is intended to be for illustrative purposes only. Embodiments of the system of the present invention may be configured for use with any of a variety of road conditions that are consistent with the purposes of the system, which purposes include, but are not limited to any of: warning road users of conditions created by work activities in or near the roadway, guiding users, and providing for smooth and gradual vehicular traffic flow from one lane to another, onto a bypass or detour, into a narrower traveled way, or the like, or any combination thereof. Such purposes also include, but are not limited to, channelizing vehicular traffic away from the work space, pavement drop-offs, pedestrian or shared-use paths, or opposing directions of vehicular traffic, or the like, or any combination thereof.

It should be understood that directing traffic, according to embodiments of the present invention, is not limited to directing vehicular traffic, but also includes directing other types of traffic, such as, but not limited to, bicycle traffic, pedestrian traffic (including accessible passage), transit operations, and access (and accessibility) to property and utilities, and the like.

In embodiments, the at least one reflective member may be made from retroreflective sheeting that has been manufactured for use on channelizing devices. The retroreflective sheeting may have a reflective member that is either white, yellow, or red in color, wherein white reflective members indicate a right side of a traffic lane, yellow reflective members indicate a left side of a traffic lane, and red reflective members indicate a road closure.

Figure 11:
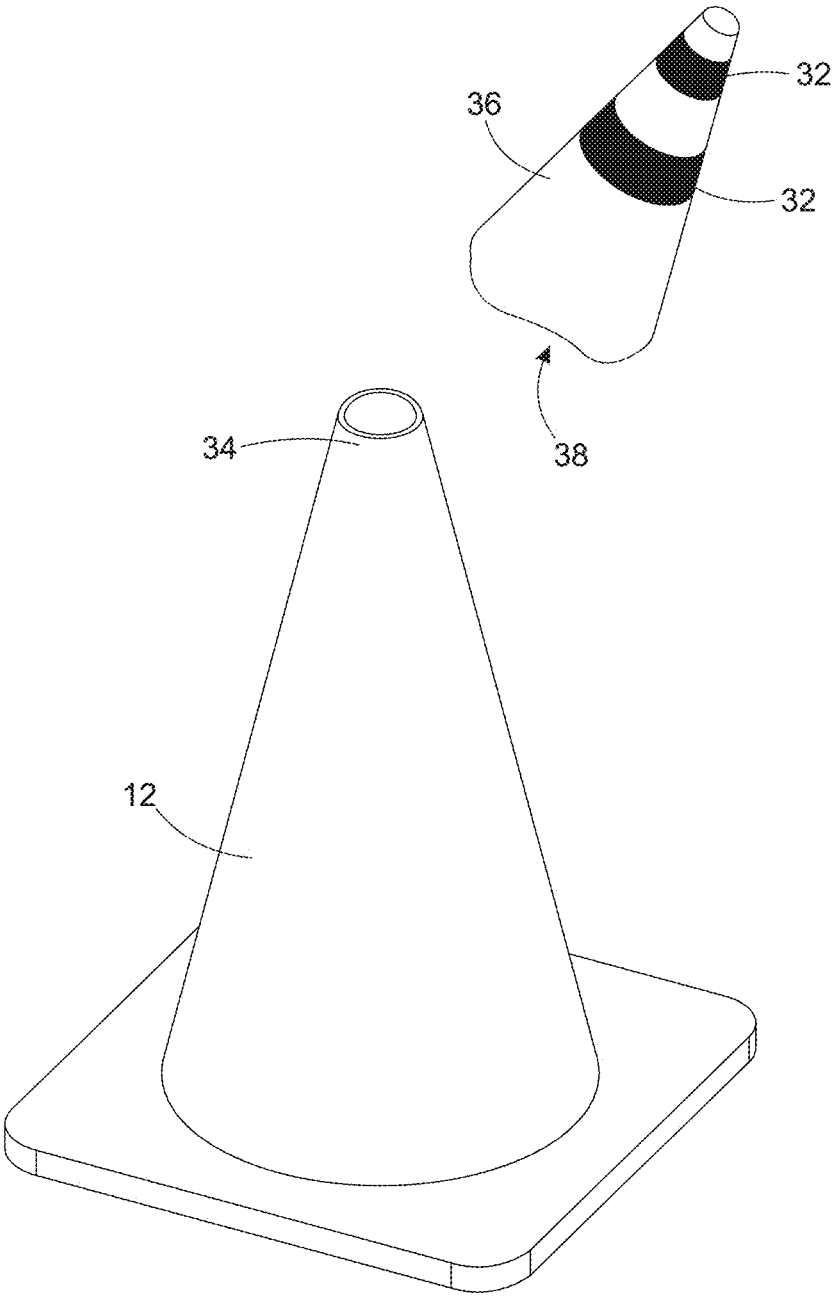
FIG. 11 is an exploded view of a cone with a sleeve, according to an embodiment.

In some embodiments, such as those embodiments that include cones 12, the at least one reflective member 32 may be an interchangeable sleeve 36, or be located on an interchangeable sleeve 36, such as may be installed by sliding the sleeve 36 over the device 12, as shown in FIG. 11. As shown in FIG. 11, sleeve 36 comprises an aperture 38 configured such that sleeve 36 may slide over the top end 34 of cone 12. Sleeve 36 may be made of flexible material or sleeve 36 may be made of rigid material. Sleeve 36 comprises at least one reflective member 32 that is either white, yellow, or red in color. In some embodiments, the reflective member may be either orange and white, orange and yellow, or orange and red in color, wherein the orange color is a background or secondary color to provide contrast with the white, yellow, or red color, in accordance with some traffic control regulations. In some embodiments, the background or secondary color may be a different color, other than orange, that is consistent with providing contrast with the white, yellow, or red color, in accordance with some traffic control regulations. Sleeve 36 may be easily removed and exchanged with a sleeve having at least one reflective member of a different color. The interchangeability of sleeve 36 reduces the cost of traffic channelizing devices 46, 48 and 50, by allowing channelizing devices to be fitted with sleeves of different colors interchangeably.

Although the device shown in FIG. 11 is a cone 12 with an interchangeable sleeve 36, this is not intended to be limiting. It is understood that, in embodiments, the at least one reflective member may be an interchangeable sleeve 36, or located on an interchangeable sleeve 36, or it may be any suitable reflective member, or located on any such suitable reflective member, that is interchangeable on a traffic channelizing device, such as a cone 12, a tubular marker 14, a channelizer 16, a portable delineator 18, a vertical panel 20, a drum 22, a Type-I barricade 24, a Type-II barricade 26, a Type-III barricade 28, a longitudinal channelizing device 30, an alternative channelizer 70, or the like.

Figure 16:
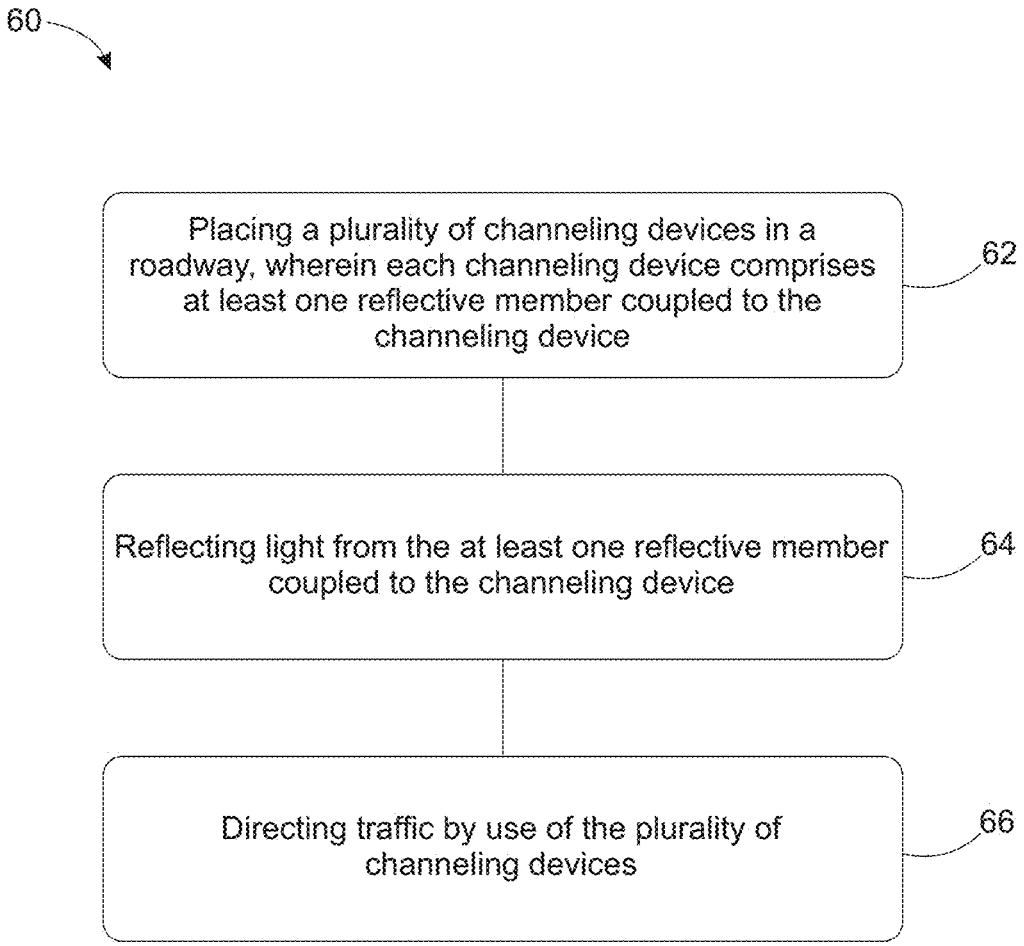
FIG. 16 is a diagram of a method of use of a system of retroreflectorized traffic control channelizing devices, according to an embodiment.

FIG. 16 illustrates a method of use 60 of a system of retroreflectorized traffic control channelizing devices. The method 60 comprises placing a plurality of channeling devices in a roadway, wherein each channeling device comprises at least one reflective member coupled to the channeling device (Step 62); reflecting light from the at least one reflective member of the plurality of channeling devices (Step 64); and directing traffic by use of the plurality of channeling devices (Step 66).

In some embodiments of method 60 of use of a traffic control channelizing system, directing traffic includes directing traffic from a right side of a traffic lane using a first portion of the plurality of channeling devices having at least one reflective member that is white in color; directing traffic from a left side of a traffic lane using a second portion of the plurality of channeling devices having at least one reflective member that is yellow in color; and stopping traffic for a road closure using a third portion of the plurality of channeling devices having at least one reflective member that is red in color.

In some embodiments of method 60 of use of a traffic control channelizing system, directing traffic includes directing traffic from a left side of a traffic lane using a second portion of the plurality of channeling devices having at least one reflective member that is yellow in color; or stopping traffic for a road closure using a third portion of the plurality of channeling devices having at least one reflective member that is red in color.

In embodiments of the method 60 of use of a traffic control channelizing system, the plurality of channelizing devices comprises cones, tubular markers, channelizers, portable delineators, vertical panels, drums, Type-I barricades, Type-II barricades, Type-III barricades, longitudinal channelizing devices, alternative channelizers, or the like, or a combination of two or more thereof.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A method of use of a traffic control channelizing system, the method comprising:

placing a plurality of temporary channeling devices in a roadway, wherein each temporary channeling device comprises at least one reflective member coupled to the channeling device;

reflecting light from the at least one reflective member of the plurality of temporary channeling devices;

directing traffic by use of the plurality of temporary channeling devices, wherein directing traffic comprises directing traffic from only a left side of a traffic lane using a first portion of the plurality of temporary channeling devices having at least one first reflective member, wherein a first portion of the at least one first reflective member of the first portion of the plurality of temporary channeling devices is yellow in color; and directing traffic from a right side of a traffic lane using a second portion of the plurality of temporary channeling devices having at least one second reflective member, wherein a first portion of the at least one second reflective member of the second portion of the plurality of temporary channeling devices is white in color.

2. The method of use of a traffic control channelizing system of claim 1 wherein directing traffic further comprises:

stopping traffic for a road closure using a third portion of the plurality of temporary channeling devices having at least one third reflective member, wherein a first portion of the at least one third reflective member of the third portion of the plurality of temporary channeling devices is red in color.

3. The method of use of a traffic control channelizing system of claim 2, wherein:

a second portion of the at least one first reflective member of the first portion of the plurality of temporary channeling devices is orange in color;

a second portion of the at least one second reflective member of the second portion of the plurality of temporary channeling devices is orange in color;

a second portion of the at least one third reflective member of the third portion of the plurality of temporary channeling devices is orange in color; or a second portion of the at least one first reflective member of the first portion of the plurality of temporary channeling devices is orange in color, a second portion of the at least one second reflective member of the second portion of the plurality of temporary channeling devices is orange in color, and a second portion of the at least one third reflective member of the third portion of the plurality of temporary channeling devices is orange in color.

4. The method of use of a traffic control channelizing system of claim 2, wherein the plurality of channelizing devices comprises cones, tubular markers, channelizers, portable delineators, vertical panels, drums, Type-I barricades, Type-II barricades, Type-III barricades, longitudinal channelizing devices, or a combination of two or more thereof.

5. A method of use of a traffic control channelizing system, the method comprising:

placing a plurality of temporary channeling devices in a roadway, wherein each temporary channeling device comprises at least one reflective member coupled to the channeling device;

reflecting light from the at least one reflective member of the plurality of temporary channeling devices;

directing traffic by use of the plurality of temporary channeling devices, wherein directing traffic comprises directing traffic from only a left side of a traffic lane using a first portion of the plurality of temporary channeling devices having at least one first reflective member, wherein a first portion of the at least one first reflective member of the first portion of the plurality of temporary channeling devices is yellow in color;

directing traffic from a right side of a traffic lane using a second portion of the plurality of temporary channeling devices having at least one second reflective member, wherein a first portion of the at least one second reflective member of the second portion of the plurality of temporary channeling devices is white in color; and stopping traffic for a road closure using a third portion of the plurality of temporary channeling devices having at least one third reflective member, wherein a first portion of the at least one third reflective member of the third portion of the plurality of temporary channeling devices is red in color.

6. The method of use of a traffic control channelizing system of claim 5, wherein:

a second portion of the at least one first reflective member of the first portion of the plurality of temporary channeling devices is orange in color;

a second portion of the at least one second reflective member of the second portion of the plurality of temporary channeling devices is orange in color;

a second portion of the at least one third reflective member of the third portion of the plurality of temporary channeling devices is orange in color; or a second portion of the at least one first reflective member of the first portion of the plurality of temporary channeling devices is orange in color, a second portion of the at least one second reflective member of the second portion of the plurality of temporary channeling devices is orange in color, and a second portion of the at least one third reflective member of the third portion of the plurality of temporary channeling devices is orange in color.

7. The method of use of a traffic control channelizing system of claim 5, wherein the plurality of channelizing devices comprises cones, tubular markers, channelizers, portable delineators, vertical panels, drums, Type-I barricades, Type-II barricades, Type-III barricades, longitudinal channelizing devices, or a combination of two or more thereof.

8. A method of use of a traffic control channelizing system, the method comprising:

placing a plurality of temporary channeling devices in a roadway, wherein each temporary channeling device comprises at least one reflective member coupled to the channeling device;

reflecting light from the at least one reflective member of the plurality of temporary channeling devices;

directing traffic by use of the plurality of temporary channeling devices, wherein directing traffic comprises directing traffic from only a left side of a traffic lane using a first portion of the plurality of temporary channeling devices having at least one first reflective member, wherein a first portion of the at least one first reflective member of the first portion of the plurality of temporary channeling devices is yellow in color; and stopping traffic for a road closure using a third portion of the plurality of temporary channeling devices having at least one third reflective member, wherein a first portion of the at least one third reflective member of the third portion of the plurality of temporary channeling devices is red in color.

9. The method of use of a traffic control channelizing system of claim 8, further comprising:

directing traffic from a right side of a traffic lane using a second portion of the plurality of temporary channeling devices having at least one second reflective member, wherein a first portion of the at least one second reflective member of the second portion of the plurality of temporary channeling devices is white in color.

10. The method of use of a traffic control channelizing system of claim 9, wherein:

a second portion of the at least one first reflective member of the first portion of the plurality of temporary channeling devices is orange in color;

a second portion of the at least one second reflective member of the second portion of the plurality of temporary channeling devices is orange in color;

a second portion of the at least one third reflective member of the third portion of the plurality of temporary channeling devices is orange in color; or a second portion of the at least one first reflective member of the first portion of the plurality of temporary channeling devices is orange in color, a second portion of the at least one second reflective member of the second portion of the plurality of temporary channeling devices is orange in color, and a second portion of the at least one third reflective member of the third portion of the plurality of temporary channeling devices is orange in color.

11. The method of use of a traffic control channelizing system of claim 9, wherein the plurality of channelizing devices comprises cones, tubular markers, channelizers, portable delineators, vertical panels, drums, Type-I barricades, Type-II barricades, Type-III barricades, longitudinal channelizing devices, or a combination of two or more thereof.

* * * * *